US007946680B2

(12) United States Patent
Ono et al.

(10) Patent No.: US 7,946,680 B2
(45) Date of Patent: May 24, 2011

(54) LIQUID DISCHARGING APPARATUS AND METHOD FOR MANUFACTURING LIQUID DISCHARGING APPARATUS

(75) Inventors: Shogo Ono, Kanagawa (JP); Manabu Tomita, Kanagawa (JP); Koichi Igarashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 764 days.

(21) Appl. No.: 11/629,222

(22) PCT Filed: Jun. 16, 2005

(86) PCT No.: PCT/JP2005/011044

§ 371 (c)(1),
(2), (4) Date: Dec. 12, 2007

(87) PCT Pub. No.: WO2005/123394

PCT Pub. Date: Dec. 29, 2005

(65) Prior Publication Data

US 2008/0204511 A1 Aug. 28, 2008

(30) Foreign Application Priority Data

Jun. 17, 2004 (JP) ..... 2004-179309

(51) Int. Cl.
*B41J 2/135* (2006.01)

(52) U.S. Cl. ..... 347/44; 347/65; 347/71

(58) Field of Classification Search ..... 347/40–47, 347/65–71, 15, 84–86
See application file for complete search history.

(56) References Cited

U.S. PATENT DOCUMENTS

| | | | | |
|---|---|---|---|---|
| 5,410,340 | A * | 4/1995 | Drake et al. | 347/62 |
| 6,749,286 | B2 | 6/2004 | Eguchi et al. | |
| 2003/0058307 | A1 | 3/2003 | Eguchi et al. | |
| 2003/0087199 | A1 | 5/2003 | Kim et al. | |
| 2004/0035823 | A1 | 2/2004 | Min et al. | |

FOREIGN PATENT DOCUMENTS

| | | | |
|---|---|---|---|
| EP | 0627318 | A1 | 2/1994 |
| JP | 06-191035 | | 7/1994 |
| JP | 2001-171120 | | 6/2001 |
| JP | 2001-179990 | | 7/2001 |
| JP | 2003-145780 | | 5/2003 |
| JP | 2004-082731 | | 3/2004 |
| WO | WO 2005-039880 | A1 | 5/2005 |

* cited by examiner

*Primary Examiner* — Thinh H Nguyen
(74) *Attorney, Agent, or Firm* — Robert J. Depke; Rockey, Depke & Lyons, LLC

(57) ABSTRACT

There is provided a head including a chip 10 that has a semiconductor substrate 11, heating elements 12 disposed on the semiconductor substrate 11, coating layers 14 disposed on the semiconductor substrate 11 and having nozzles 14*a* arranged in regions above the respective heating elements 12, and individual channels 14*b* each communicating with the outside and the region above the corresponding heating element 12, wherein the semiconductor substrate 11 does not have a through hole communicating with each individual channel 14*b*; a ink feed member 21 having a common channel 21*b*, the ink feed member 21 being bonded to the chip 10 in such a manner that the common channel 21*b* communicates with the individual channels 14*b*; and a top 22 disposed on the chip 10 and the ink feed member 21 so as to seal the opening of the common channel 21*b*.

7 Claims, 10 Drawing Sheets

LIQUID DISCHARGING APPARATUS AND METHOD FOR MANUFACTURING LIQUID DISCHARGING APPARATUS

This application is a 371 U.S. National Stage filing of PCT/JP2005/011044, filed Jun. 16, 2005, which claims priority to Japanese Patent Application Number 2004-179309, filed Jun. 17, 2004, all of which are incorporated herein by reference.

TECHNICAL FIELD

The present invention relates to a liquid discharge head used as a print head or the like for an inkjet printer and relates to a process for producing the liquid discharge head. Specifically, the present invention relates to an inexpensive liquid discharge head having satisfactory yield produced without forming a through hole in a semiconductor substrate and relates to a process for producing the liquid discharge head.

BACKGROUND ART

FIG. 10 is a cross-sectional view of a thermal print head as an example of a known liquid discharge head. In FIG. 10, the print head includes an ink feed member 2 and a chip 1 bonded on the ink feed member 2. The chip 1 includes heater elements 3 disposed on a semiconductor substrate 1*a*; and a coating layer 4 disposed so as to position nozzles 4*a* above the respective heater elements 3. An individual channel 4*b* extends from regions above the heater elements 3 to a periphery region communicating with the regions above the heater elements 3. Furthermore, the semiconductor substrate 1*a* includes a through hole 1*b*.

On the other hand, the ink feed member 2 includes an ink feed opening 2*a* and a common channel 2*b* through the base of the ink feed member 2, the common channel 2*b* communicating with the ink feed opening 2*a*.

In the print heat, ink is fed from an external ink tank (not shown) or the like into the common channel 2*b* through the ink feed opening 2*a*. The ink enters the individual channel 4*b* through the through hole 1*b*. As a result, the regions above the heater elements 3 are filled with the ink.

Rapid heating of the heater elements 3 in this state generates bubbles on the heater elements 3. A change in pressure during the generation of the bubbles discharges the droplet of ink above the heater elements 3 through the nozzles 4*a*. The discharged ink reaches a recording medium or the like to form a pixel.

The print head is produced as described below.

First, the heater elements 3 are formed by semiconductor production techniques or the like on a substrate (semiconductor substrate 1*a*) composed of, for example, silicon. A pattern composed of a soluble resin, e.g. a photosensitive resin such as a photoresist is formed by photolithographic techniques on the heater elements 3 to form a sacrificial layer (not shown). The coating layer (resin layer) 4 to be a structure is formed on the sacrificial layer by application such as spin coating.

The nozzles 4*a* are formed by dry etching in the coating layer 4. When the coating layer 4 is composed of a photosensitive resin, the nozzles 4*a* are formed by a photolithographic technique. The through hole 1*b* serving as the ink feed opening 2*a* is formed by wet etching from the back side of the semiconductor substrate 1*a* as described in, for example, Japanese Patent No. 3343875. A dissolving liquid for the sacrificial layer is poured through the through hole 1*b*. When the sacrificial layer is composed of a photosensitive resin, a developer or the like is poured through the through hole 1*b*.

Thereby, the sacrificial layer is dissolved (eluted) to form the chip 1.

The ink feed member 2 is composed of aluminum, stainless steel, or a resin and is formed by machining. The chip 1 is bonded to the ink feed member 2. Thereby, a print head is completed.

In the known technique, the through hole 1*b* is formed in the semiconductor substrate 1*a* from the back side of the semiconductor substrate 1*a*. The dissolving liquid for the sacrificial layer is poured through the through hole 1*b* to dissolve the sacrificial layer. The step of forming the through hole 1*b* in the semiconductor substrate 1*a* is usually performed by either anisotropic wet etching or dry etching, or a combination of both.

However, anisotropy etching has disadvantages as described below.

First, the etch rate is very low (about 0.5 to about 1.0 μm/min). For example, the time required for forming the through hole 1*b* in the semiconductor substrate 1*a* having a thickness of about 600 μm is at least about 10 hours. Thus, it disadvantageously takes a very long production time.

Secondly, a member functioning as an etching mask needs to be formed in a region other than the through hole 1*b* before forming the through hole 1*b*, thus disadvantageously complicating the process.

Thirdly, in the case where an aluminum pad or the like is disposed on a surface of the semiconductor substrate 1*a*, when an etching solution reaches the surface, the aluminum pad is disadvantageously etched. Thus, it is necessary to prevent the etching solution from reaching the surface. Alternatively, it is necessary to form a protective film so as not to cause a problem even when the etching solution reaches the surface.

On the other hand, dry etching also has disadvantages as described below.

First, the etch rate is disadvantageously lower than that in anisotropic etching.

Secondly, an etching mask is disadvantageously required in the same way as the second problem in anisotropic etching.

As described above, the use of etching techniques complicates the production process and prolongs the production time. Thus, the print head has poor yield, resulting in high costs.

DISCLOSURE OF INVENTION

Accordingly, it is an object of the present invention to provide a simple process for producing a liquid discharge head in satisfactory yield at low costs, the process not including a (etching) step of forming a through hole in a semiconductor substrate.

The present invention overcomes the problems by means for solving the problems as described below.

According to a first aspect of the present invention, a liquid discharge head includes a semiconductor chip that has a semiconductor substrate; a plurality of heating elements disposed on the semiconductor substrate, the heating elements being arranged in a direction; a coating layer disposed on the semiconductor substrate, the coating layer having nozzles, each of the nozzles being arranged above a corresponding one of the heating elements; and individual channels disposed between the semiconductor substrate and the coating layer, each of the individual channels communicating with the outside and a region above the corresponding one of the heating elements, wherein the semiconductor chip does not have a through hole communicating with each individual channel; a liquid feed member having a common channel through a base, the liquid feed member being bonded to the semiconductor chip in such a manner that the common channel communicates with the individual channels of the semiconductor chip; and a seal member disposed on the coating layer of the semiconductor chip and the liquid feed member so as to seal the opening of the common channel.

In the first aspect of the present invention, the semiconductor substrate does not have a through hole. The seal member seals the gap between the liquid feed member and the semiconductor chip when the semiconductor chip is bonded to the liquid feed member, i.e., the seal member seals the opening of the common channel. Thereby, the common channel defined by the liquid feed member, the semiconductor chip, and the seal member is formed.

According to a second aspect of the present invention, a process for producing a liquid discharge head includes a first step of forming a plurality of heating elements on a semiconductor substrate, the heating elements being arranged in a direction; a second step of forming a sacrificial layer on a region including areas on the heating elements, the sacrificial layer being soluble in a dissolving liquid; a third step of forming a coating layer on the sacrificial layer; a fourth step of forming nozzles in regions of the coating layer after or simultaneously with the third step, each of the regions being located above the corresponding heating element, and each of the nozzles passing through the coating layer; a fifth step of cutting the semiconductor substrate along the stacking direction of the sacrificial layer and the coating layer to form semiconductor chips each exposing the sacrificial layer at the corresponding cut end; and a sixth step of immersing the semiconductor chips formed in the fifth step in the dissolving liquid to dissolve the sacrificial layer, wherein the process further comprises: a bonding step of bonding each semiconductor chip at latest after the fifth step to a liquid feed member including a common channel passing through a base in such a manner that each cut end of the corresponding semiconductor chip faces the common channel; and a sealing step of sealing an opening of the common channel with a seal member in such a manner that the seal member is disposed on the liquid feed member and the coating layer of each semiconductor chip bonded in the bonding step.

In the second aspect of the present invention, the semiconductor chip is produced through the first to sixth steps. In the process for producing the semiconductor chip, a step of forming a through hole in the semiconductor substrate is not performed. The individual channels, which include the areas (chamber for a liquid) on the heating elements, in the semiconductor chip are formed between the semiconductor substrate and the coating layer by dissolution of the sacrificial layer.

The gap between the liquid feed member and the semiconductor chip, i.e., the opening of the common channel, is sealed in the sealing step.

According to the first aspect of the present invention, the common channel and the individual channels can be formed without the formation of a through hole in the semiconductor substrate.

According to the second aspect of the present invention, the liquid discharge head including the common channel and the individual channels can be produced without a step of forming a through hole in the semiconductor substrate. Thereby, the liquid discharge head having satisfactory yield can be produced at low costs.

BEST MODE FOR CARRYING OUT THE INVENTION

An embodiment of the present invention will be described below with reference to the drawings. In the following embodiments, a thermal inkjet print head (hereinafter, simply referred to as a "head") and a process for producing the thermal inkjet print head are exemplified as a liquid discharge head and a process for producing the liquid discharge head according to the present invention.

First Embodiment

FIGS. 1 to 5 are each a sectional side view sequentially illustrating a process for producing a head according to a first embodiment.

Figure 1:
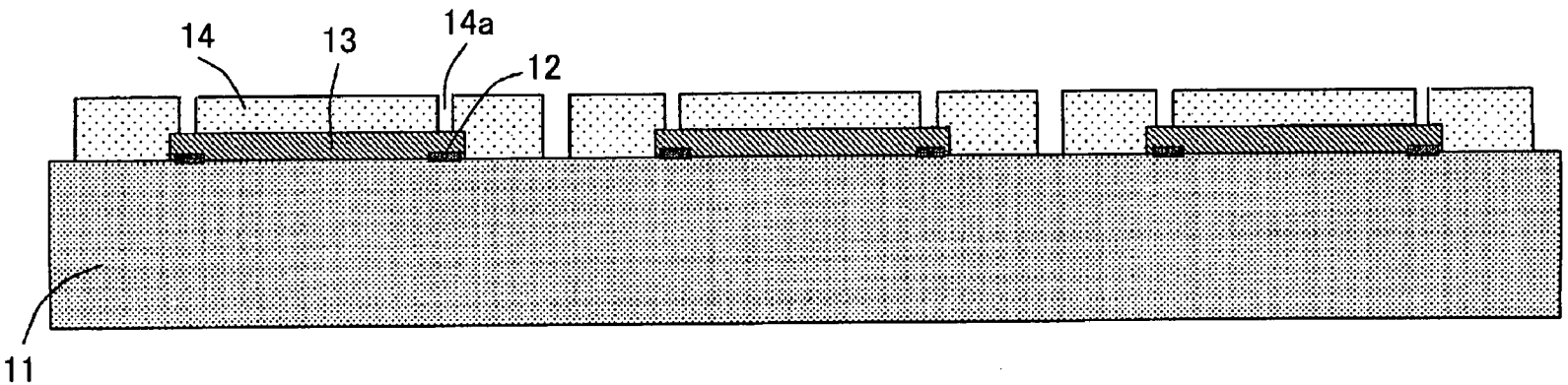
FIG. 1 is a sectional side view sequentially illustrating a process for producing a head according to a first embodiment.

In FIG. 1, heating elements 12 is formed on a semiconductor substrate 11 composed of silicon, glass, ceramic material, or the like by fine processing technology for production of semiconductors and electronic devices (first step). In FIG. 1, the heating elements 12 are arranged at predetermined spacing in the longitudinal direction of the semiconductor substrate 11. Furthermore, with respect to the direction perpendicular to the paper plane in FIG. 1, the heating elements 12 are continuously arranged with a predetermined pitch in a direction. For example, to make a head having a resolution of 600 dpi, the heating elements 12 have a pitch of 42.3 (μm) in the direction perpendicular to the paper plane.

Sacrificial layers 13 are formed in regions to be individual channels in a semiconductor chip, each of the regions including areas (to be a chamber for a liquid) on the heating elements 12 (second step). The sacrificial layers 13 are each formed of a resin layer composed of a photoresist or the like.

Coating layers 14 are formed on ranges including the regions having the sacrificial layers 13 (third step). The coating layers 14 function as known nozzle sheets and barrier layers and are formed by application such as spin coating.

Nozzles 14 are formed in the coating layers 14 in such a manner that each of the nozzles is located directly above the corresponding heating element 12 (fourth step). The nozzles 14 are formed of a photoresist or the like so as to reach the sacrificial layers 13, i.e., so as to pass through the coating layers 14.

Figure 2:
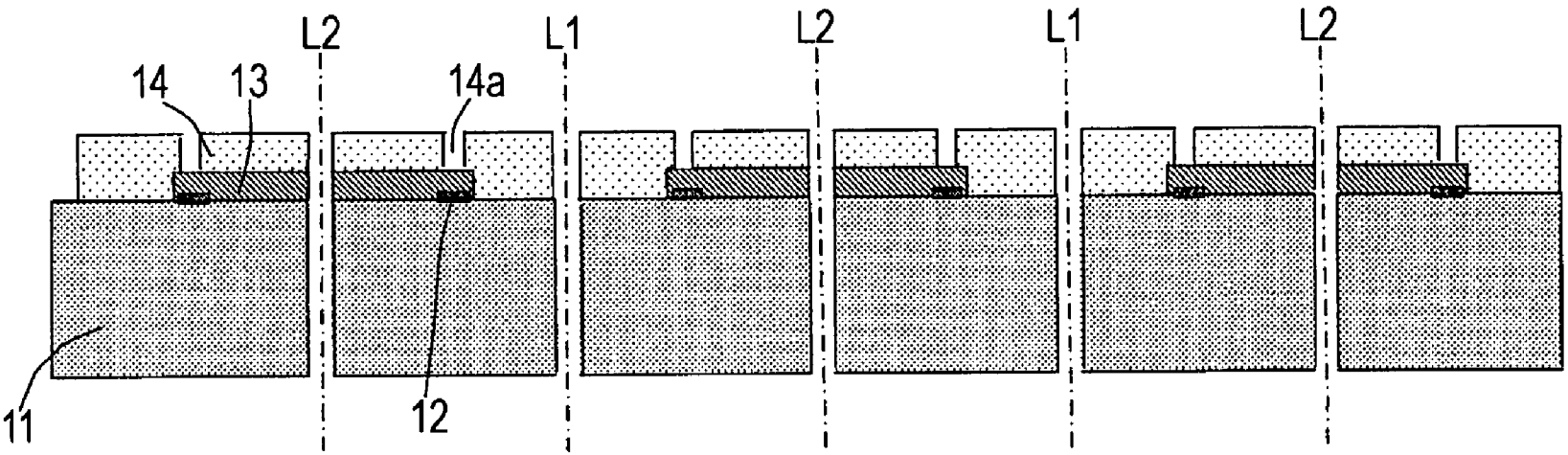
FIG. 2 is an explanation drawing illustrating a production step subsequent to the production step shown in FIG. 1.

As shown in FIG. 2, the semiconductor substrate 11 is cut with a dicing machine or the like along cut lines L1 and cut lines L2 (fifth step). FIG. 2 shows cut lines L1 and cut lines L2. Cut lines L1 are cut lines lying in portions not including the sacrificial layer 13. In this embodiment, cut lines L1 lie in the portions not including both of the sacrificial layer 13 and the coating layer 14.

Cut lines L2 are cut lines each lying in a substantially middle portion of the corresponding (continuous) sacrificial layer 13. Cutting the substrate along cut line L2 results in symmetrical semiconductor substrates 11 at both sides of cut line L2, the resulting symmetrical semiconductor substrates having the same shape when one of the symmetrical semiconductor substrates is reversed by 180°.

Since cut lines L2 are cut lines lying on the respective sacrificial layers 13, the sacrificial layers 13 are exposed at end faces thereof after cutting.

Hereinafter, one of the resulting cut pieces shown in FIG. 2 is referred to as a "chip (semiconductor chip)".

Cutting as shown in FIG. 2 is difficult to be performed in the absence of the sacrificial layers 13.

The absence of the sacrificial layers 13 causes cavities corresponding to the sacrificial layers 13 to function as clearances during cutting, thus affecting processing accuracy and the like.

Figure 3:
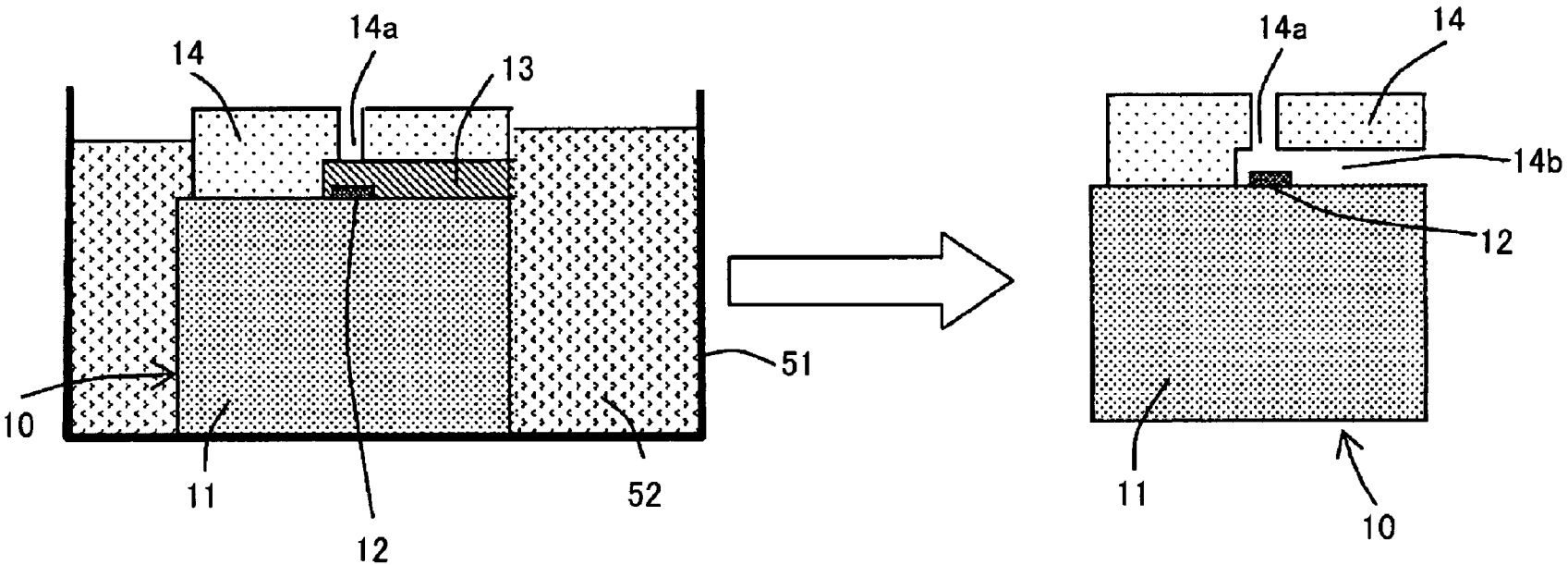
FIG. 3 is an explanation drawing illustrating a production step subsequent to the production step shown in FIG. 2.

As shown in FIG. 3, each chip 10 is immersed in a tank 51 containing a dissolving liquid 52 (sixth step). When the sacrificial layers 13 is each composed of a photoresist, the dissolving liquid 52 is preferably a developer for the photoresist. Alternatively, for example, the cut ends may be sprayed with the dissolving liquid 52 without immersion in the dissolving liquid 52.

When each chip 10 is immersed in the dissolving liquid 52, the sacrificial layers 13 in the chip 10 are dissolved in the dissolving liquid 52 to form a fluid. The fluid is drained (eluted) to the outside. On the other hand, the coating layers 14 are not changed in shape and the like before and after immersion in the dissolving liquid 52. As shown in the right side in FIG. 3, cavities are formed in portions that had been occupied with the sacrificial layers 13. The cavities constitute individual channels 14*b* each including the chamber for a liquid. The nozzles 14*a* communicate with the respective individual channels 14*b* after the dissolution of the sacrificial layers 13. The heating elements 12 are disposed in the respective individual channels 14*b*.

Thereby, the chips 10 each include the semiconductor substrate 11, the heating elements 12, and the coating layer 14 having the nozzles 14*a* and the individual channels 14*b*.

Figure 4:
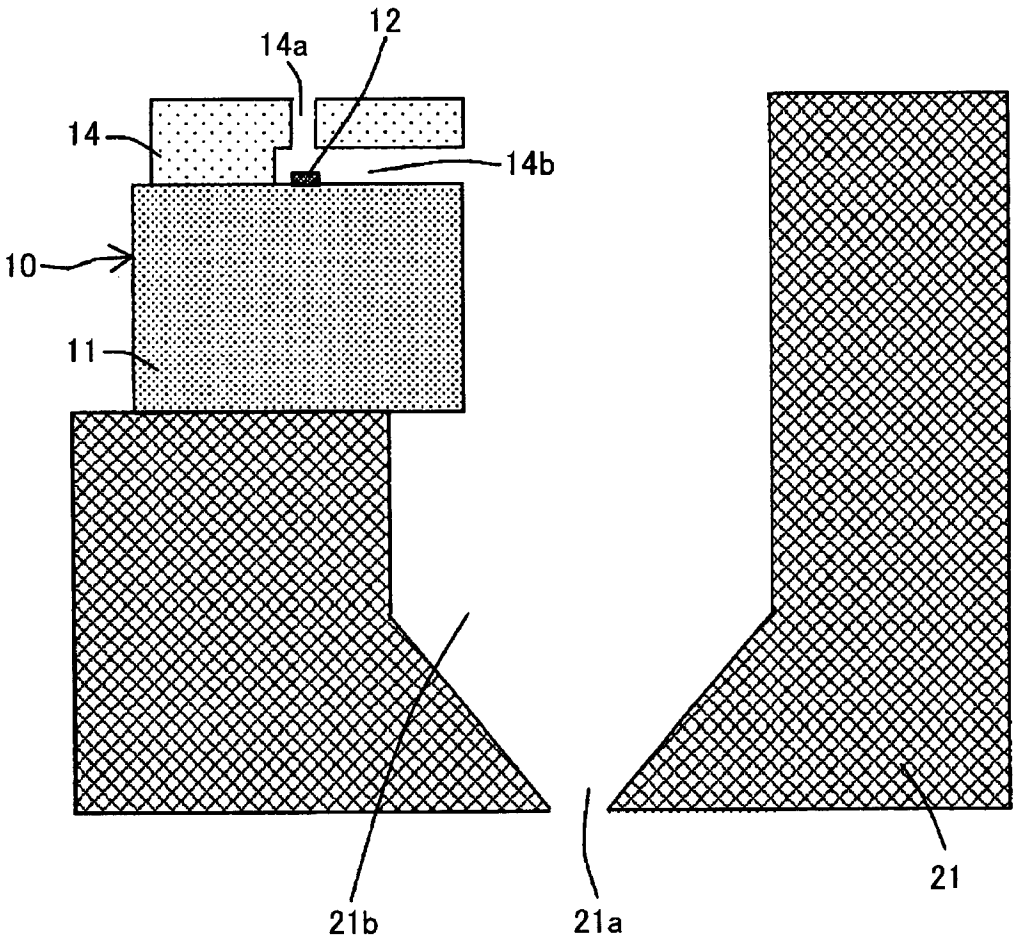
FIG. 4 is an explanation drawing illustrating a production step subsequent to the production step shown in FIG. 3.

As shown in FIG. 4, each chip 10 is bonded to an ink (liquid) feed member 21 (bonding step). The ink feed member 21 is composed of aluminum, stainless steel, a ceramic material, a resin, or the like and has a hole vertically passing through a base in the figure. The lower side of the through hole functions as an ink (liquid) feed opening 21*a*. The interior of the through hole functions as a common channel 21*b*.

In the ink feed member 21 according to an embodiment shown in FIG. 4, a face to which each chip 10 is bonded has lower in height than the other face. As shown in FIG. 4, when the chip 10 is bonded, an upper face of the coating layer 14 of the chip 10 has substantially the same height as the other face, which is not bonded to the chip 10, of the ink feed member 21.

Each chip 10 is bonded in such a manner that openings of the individual channels 14*b* face the common channel 21*b*.

Figure 5:
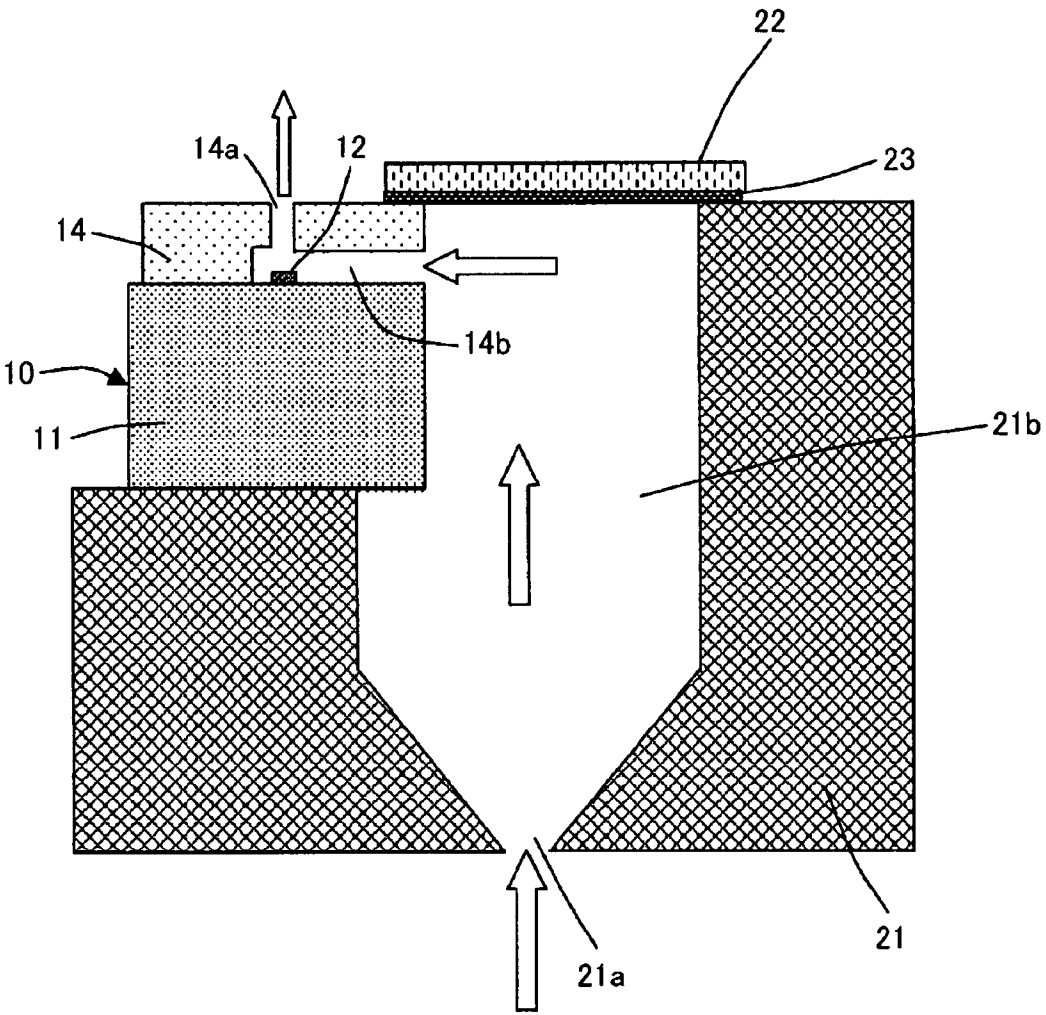
FIG. 5 is an explanation drawing illustrating a production step subsequent to the production step shown in FIG. 4.

Subsequently, as shown in FIG. 5, a top 22 (corresponding to a seal member of the present invention) is bonded with an adhesive 23 so as to be disposed on the upper face of the coating layer 14 of the chip 10 and the upper face of the ink feed member 21 (sealing step).

The top 22 is a sheet member formed of a resin film composed of a polyimide, a PET, or the like or formed of a metal foil composed of nickel, aluminum, stainless steel, or the like. The adhesive 23 is disposed at the lower face of the top 22 in advance or is disposed on the coating layer 14 and the upper face of the ink feed member 21. The adhesive 23 is bonded by thermocompression or the like.

As a result, the opening disposed at the upper side of the ink feed member 21 is sealed with the top 22. In other words, the opening of the upper side is capped with the top 22. Thereby, the common channel 21*b* is defined by the ink feed member 21, the chip 10, and the top 22.

The step of dissolving the sacrificial layers 13 (FIG. 3) may be performed after the step of bonding the chip 10 to the ink feed member 21 (FIG. 4) or after the step of bonding the top 22 (FIG. 5).

As shown in FIG. 5, ink enters the ink feed member 21 through the ink feed opening 21*a*, passes through the common channel 21*b*, and enters the individual channels 14*b* of the chip 10. Heating the heating elements 12 in this state generates bubbles in ink on the heating elements 12. A change in pressure during the generation of the bubbles, i.e., expansion and shrinkage of the bubbles, discharges part of ink as droplets to the outside through the nozzles 14*a*. In FIG. 5, the flow of ink is indicated by arrows.

Second Embodiment

Figure 6:
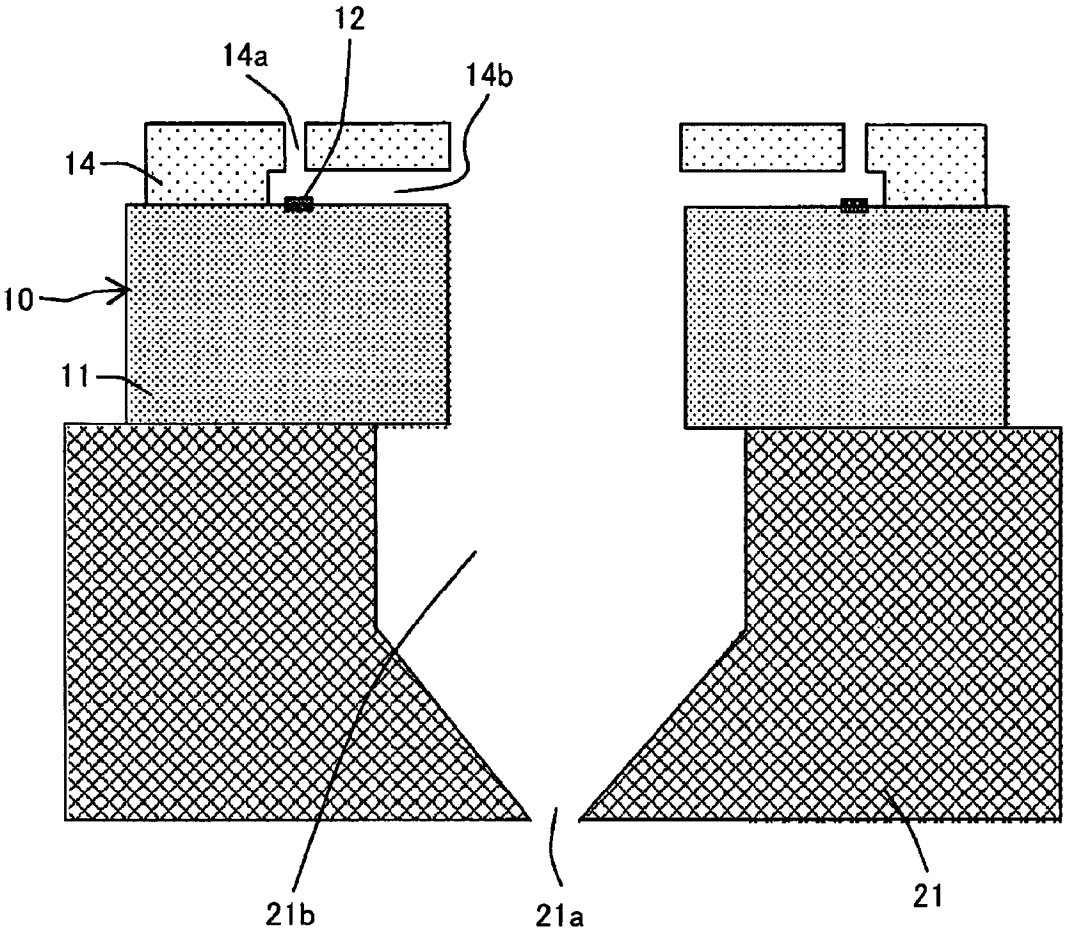
FIG. 6 is a sectional side view according to a second embodiment, the view corresponding to FIG. 4 showing the first embodiment.
Figure 7:
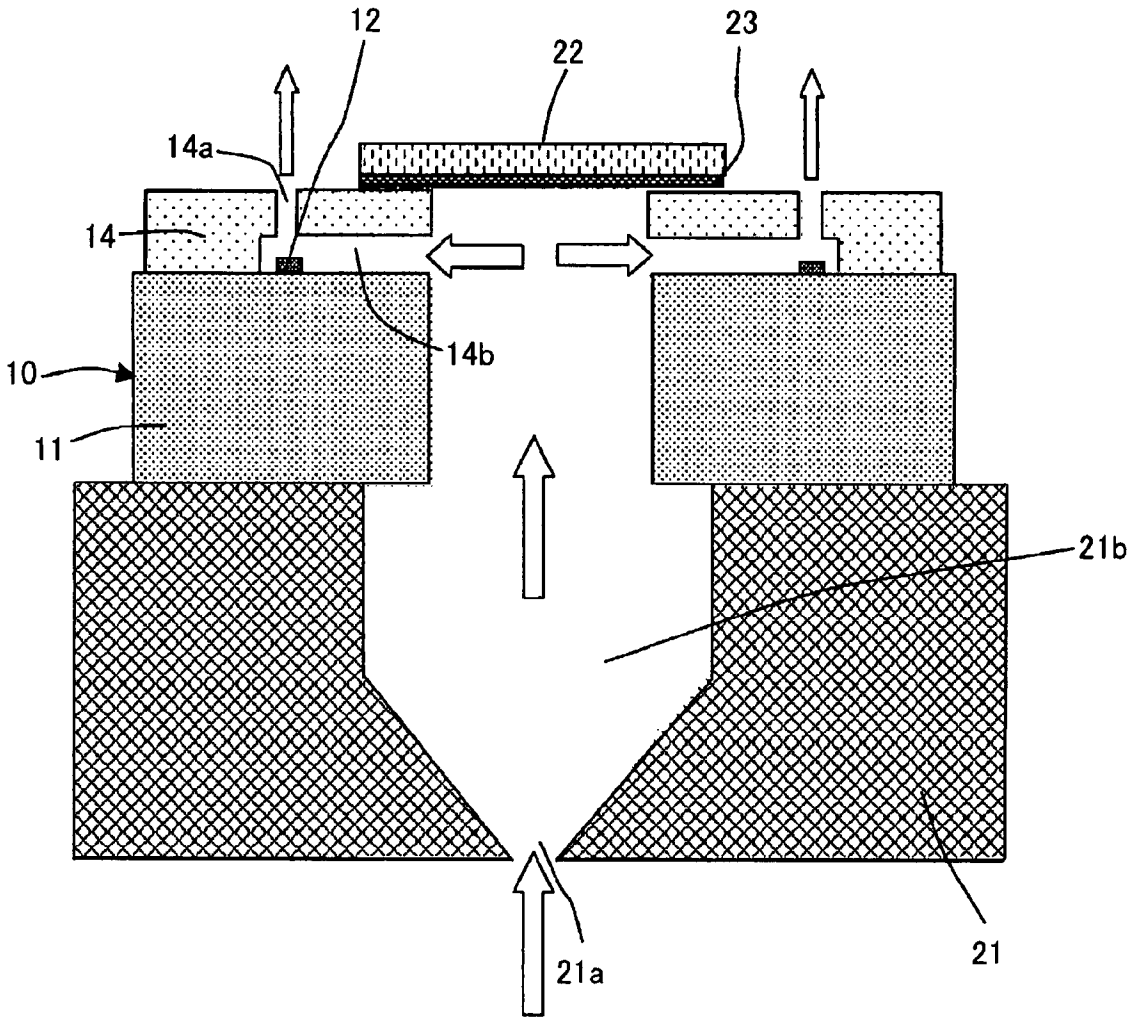
FIG. 7 is a sectional side view according to a second embodiment, the view corresponding to FIG. 5 showing the first embodiment.

FIGS. 6 and 7 are each a sectional side view according to a second embodiment of the present invention. FIGS. 6 and 7 correspond to FIGS. 4 and 5, respectively. The chips 10 used in the second embodiment are identical to those in the first embodiment. The ink feed member 21 differs in shape from that in the first embodiment. The number of chips 10 differs from that in the first embodiment. Materials of the ink feed member 21 and the top 22 are identical to those in the first embodiment.

In the first embodiment (FIG. 4), the chip 10 is bonded to one side of the ink feed member 21 across the through hole (common channel 21*b*) from the other side.

In contrast, in the second embodiment, the upper faces of the ink feed member 21 have the same height. The chips 10 are bonded to both sides of the ink feed member 21 across the through hole (common channel 21*b*) from each other.

As shown in FIG. 6, the chips 10 are bonded in such a manner that openings of the individual channels 14*b* face the common channel 21*b* and face across the common channel 21*b* from each other. The upper faces, which are bonded to the chips 10, of the ink feed member 21 are equal in height. Thus, when the chips 10 are bonded, upper faces of the coating layers 14 of the chips 10 are equal in height.

As shown in FIG. 7, the top 22 is bonded using the adhesive 23 so as to be disposed on the coating layers 14 of the chips 10.

In FIG. 7, the flow of ink is indicated by arrows in the same way as in FIG. 5. As shown in FIG. 7, ink enters the ink feed member 21 through the ink feed opening 21*a*, passes through the common channel 21*b*, and enters the individual channels 14*b* in the chips 10.

The head shown in FIG. 5 or 7 eliminates a step of forming a through hole or the like in the semiconductor substrate 11, the step having been conventionally performed. Thus, the head can be formed through simple steps.

Examples of the present invention will be described below.

Example 1

Figure 8:
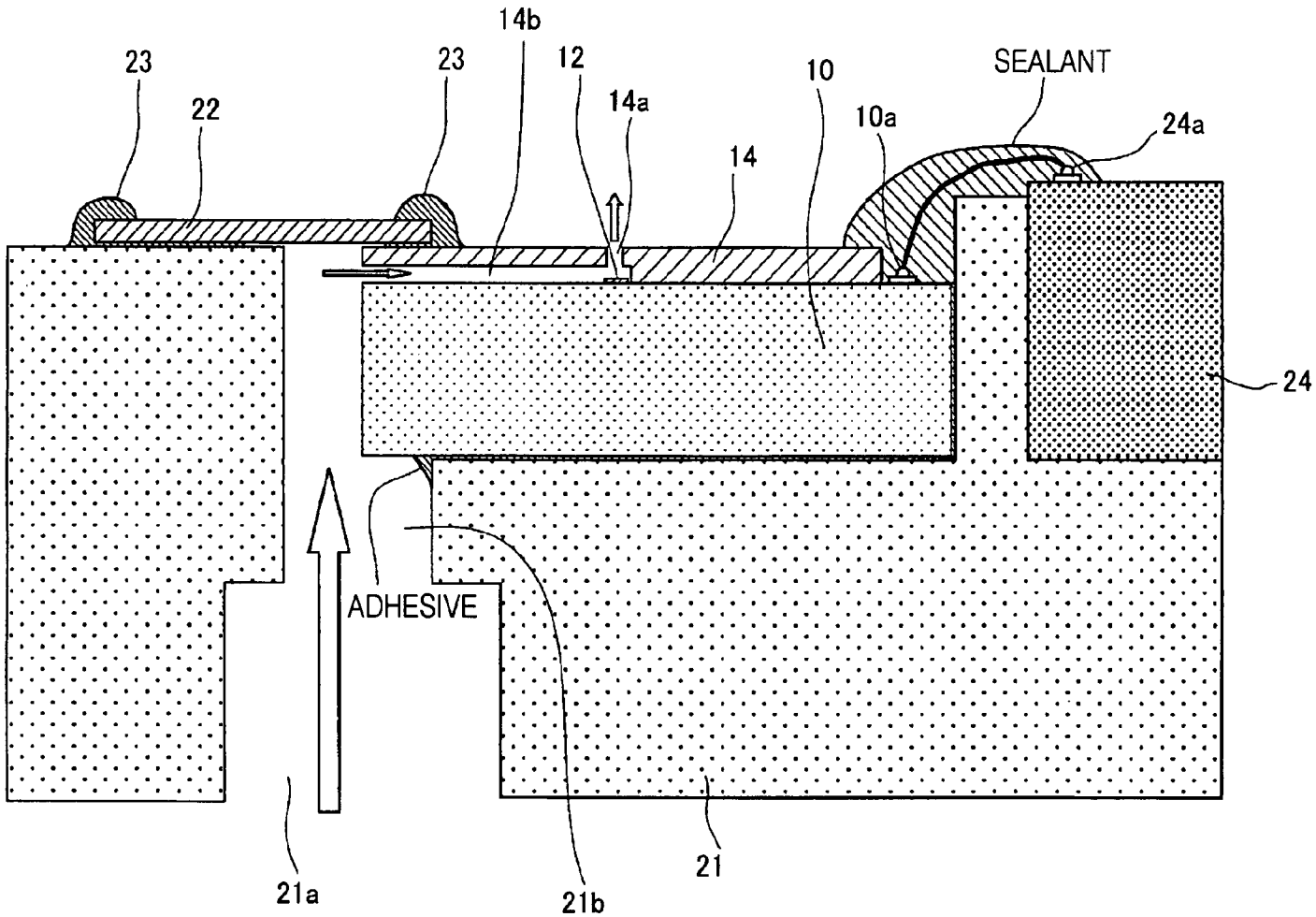
FIG. 8 is a sectional side view of a head according to EXAMPLE 1.

FIG. 8 is a sectional side view of a head according to EXAMPLE 1.

A positive photoresist PMER-LA900 (manufactured by Tokyo Ohka Kogyo Co., Ltd.) was applied by spin coating on a silicon wafer (semiconductor substrate 11) including heating elements 12 so as to have a thickness of 10 μm. After exposure with a mask aligner, the applied photoresist was developed with a developer (3% aqueous solution of tetramethylammonium hydroxide) and rinsed with deionized water to form a channel pattern. The entire resist pattern was exposed with the mask aligner and allowed to stand for 24 hours in a nitrogen atmosphere.

A photocurable negative photoresist was applied by spin coating on the resulting patterned resist at the number of revolution such that the photoresist has a thickness of 10 μm on sacrificial layers 13. Exposure was performed with a mask aligner. Developing was performed with a developer (OK73 thinner, manufactured by Tokyo Ohka Kogyo Co., Ltd). Rinse was performed with a rinse liquid (IPA). Furthermore, nozzles 14*a* each having a diameter of 15 μm were formed above the heating elements 12.

The wafer was subjected to dicing with a dicing machine to cut the wafer into pieces each having a desired chip size, thus forming chips 10. A photomask for the positive resist was designed in such a manner that dicing lines lie on the patterned positive photoresist.

Next, the chips 10 were continued to be immersed in an organic solvent (PGMEA) capable of dissolving the positive photoresist while applying ultrasonic vibration until the positive photoresist was completely dissolved and eluted.

Replacement with IPA and drying were performed to form the nozzles 14*a* and individual channels 14*b*.

On the other hand, an ink feed member 21 composed of stainless steel was formed by machining. As shown in FIG. 8, the chip 10 was bonded using a silicone adhesive in such a manner that entrances of the individual channels 14*b* of the chip 10 face the common channel 21*b*. Bonding was performed by allowing the chip to stand at room temperature for 1 hour. The ink feed member was designed in such a manner that the upper face of the ink feed member 21 had substantially the same height as the upper face of the chip 10 in this state. Then, a polyimide sheet (top 22) having a desired shape and having a thickness of 25 μm was bonded to the faces that had the same height.

The silicone adhesive was also used here as an adhesive (adhesive 23) under the same bonding conditions. Furthermore, the silicone adhesive was applied along the periphery of the polyimide sheet to surely seal the sheet so as to prevent ink from leaking. In a series of bonding, the amount of the adhesive applied was exactly adjusted so as to prevent occlusion of the common channel 21*b* and the nozzles 14*a* due to the overflow of the silicone adhesive.

Then, a terminal 24*a* on a printed-circuit board 24 for driving the chip 10 was connected to a terminal 10*a* (pad) on the chip 10 by wire bonding. Furthermore, the connection portion was sealed with a sealant (epoxy resin adhesive) so as to prevent the connection portion from being in contact with ink.

The resulting head was tested for ink discharging. The results demonstrated that there was no failure, such as defective operation due to leakage of ink, and ink could be stably discharged.

Example 2

Figure 9:
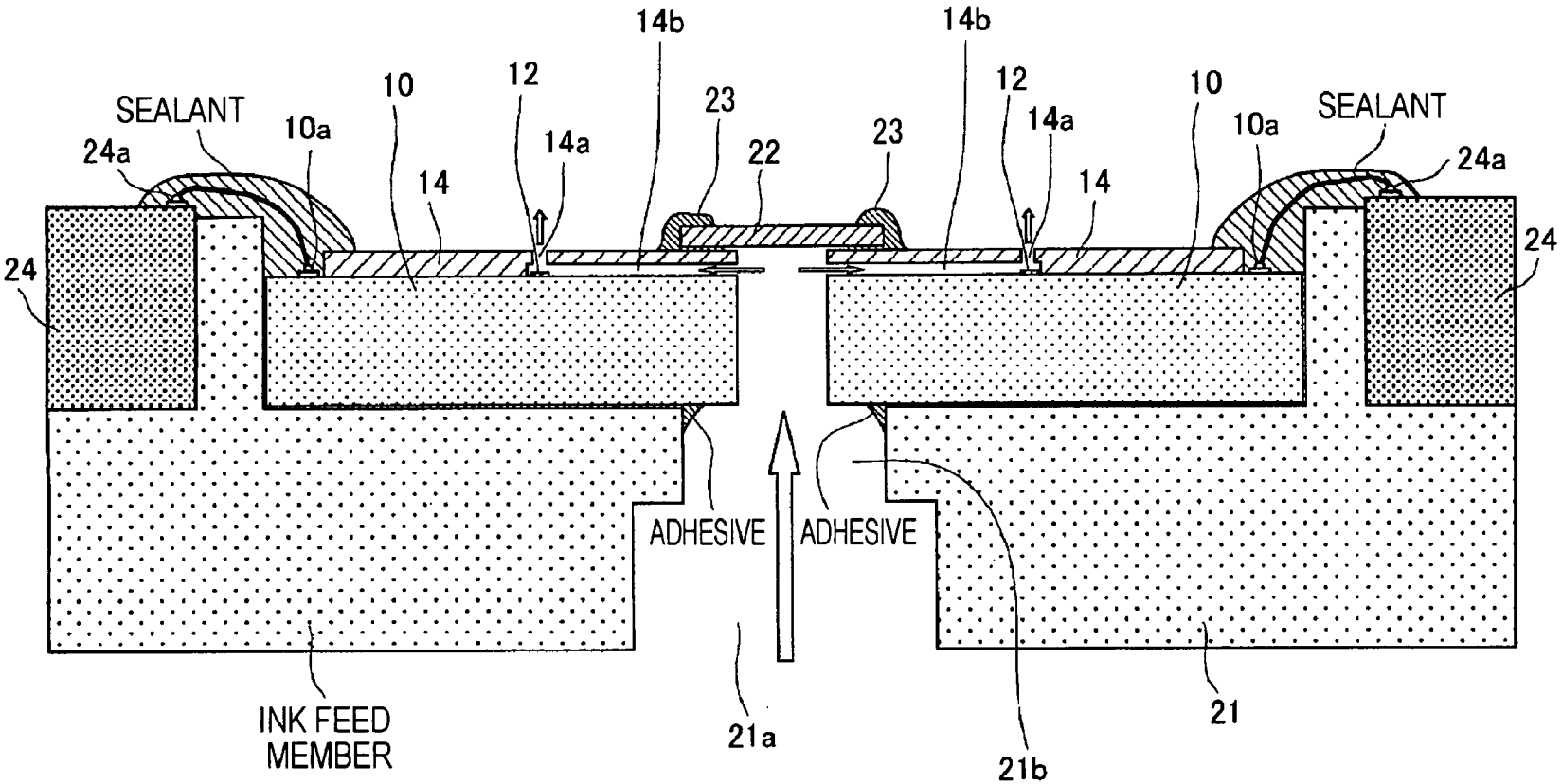
FIG. 9 is a sectional side view of a head according to EXAMPLE 2.
Figure 10:
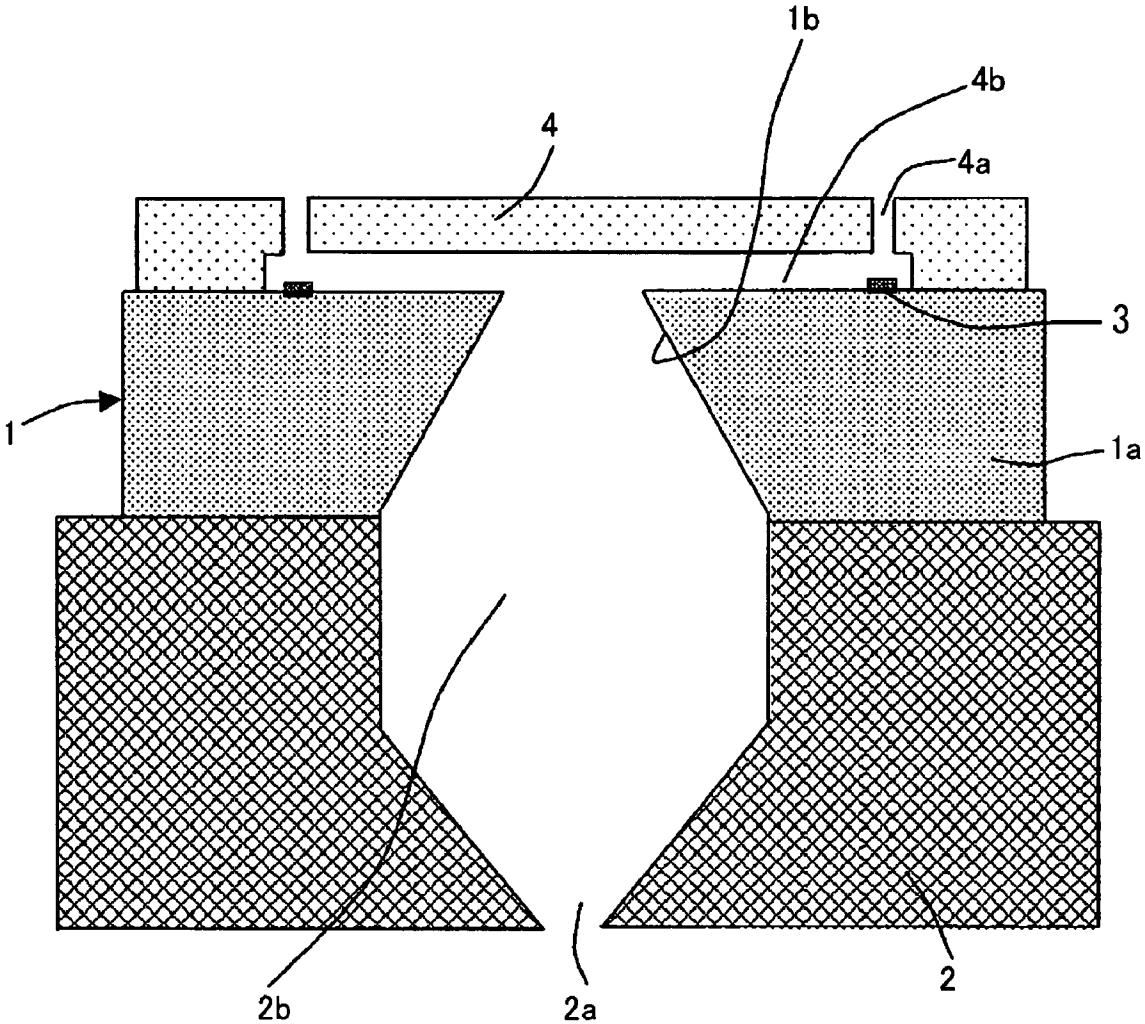
FIG. 10 is a cross-sectional view of a thermal print head as an example of a known liquid discharge head.

FIG. 9 is a sectional side view of a head according to EXAMPLE 2.

Chips 10 including heating elements 12, nozzles 14*a*, and individual channels 14*b* were produced in the same procedure as in EXAMPLE 1.

On the other hand, an ink feed member 21 composed of stainless steel was formed by machining. The chips 10 were bonded to the ink feed member 21 with a silicone adhesive. As shown in FIG. 9, the chips 10 were disposed in such a manner that entrances of individual channels 14*b* opposite each other face a common channel 21*b*. Bonding was performed by allowing the chips to stand at room temperature for 1 hour.

The faces of the ink feed member 21 for bonding with the chips 10 were designed so as to have the same height. Thus, upper faces of coating layers 14 of the chips 10 were equal in height. A polyimide sheet (top 22) having a desired shape and having a thickness of 25 μm was bonded to the upper faces, which were equal in height, of coating layers 14 of the chips 10. The silicone adhesive was also used here as an adhesive (adhesive 23). Furthermore, the silicone adhesive was applied along the periphery of the polyimide sheet to surely seal the sheet so as to prevent ink from leaking. In a series of bonding, the amount of the adhesive applied was exactly adjusted so as to prevent occlusion of the common channel 21*b* and the nozzles 14*a* due to the overflow of the silicone adhesive.

Then, terminals 24*a* on printed-circuit boards 24 for driving the chips 10 were connected to terminals 10*a* (pads) on the chips 10 by wire bonding. Furthermore, the connection portions were sealed with a sealant (epoxy resin adhesive) so as to prevent the connection portions from being in contact with ink.

The resulting head was tested for ink discharging. The results demonstrated that there was no failure, such as defective operation due to leakage of ink, and ink could be stably discharged.

The invention claimed is:

1. A liquid discharge head comprising:

a semiconductor chip including:

a semiconductor substrate;

a plurality of heating elements disposed on the semiconductor substrate, the heating elements being arranged in a direction;

a coating layer disposed over the semiconductor substrate, the coating layer having nozzles, each of the nozzles being arranged above a corresponding one of the heating elements; and individual channels disposed between the semiconductor substrate and the coating layer, each of the individual channels communicating with the outside and a region above the corresponding one of the heating elements, wherein ink flow paths at surfaces of the semiconductor chip have not been formed by etching the semiconductor chip;

a liquid feed member having a common channel through a base, the liquid feed member being bonded to the semiconductor chip in such a manner that the common channel communicates with the individual channels of the semiconductor chip; and a seal member disposed on the coating layer of the semiconductor chip and the liquid feed member so as to seal the opening of the common channel.

2. The liquid discharge head according to claim 1, wherein the liquid feed member has a first face for bonding with the semiconductor chip and a second face for bonding with the seal member, the first face is lower in height than the second face, and the second face is the same height as an upper face of the coating layer of the semiconductor chip.

3. A liquid discharge head comprising:

a pair of semiconductor chips, each semiconductor chip including:

a semiconductor substrate;

a plurality of heating elements disposed on the semiconductor substrate, the heating elements being arranged in a direction;

a coating layer disposed over the semiconductor substrate, the coating layer having nozzles, each of the nozzles being arranged above a corresponding one of the heating elements; and individual channels disposed between the semiconductor substrate and the coating layer, each of the individual channels communicating with the outside and a region above the corresponding one of the heating elements, wherein ink flow paths at surfaces of the semiconductor chip have not been formed by etching the semiconductor chip;

a liquid feed member having a common channel through a base, the liquid feed member being bonded to the pair of semiconductor chips facing each other in such a manner that the common channel communicates with the individual channels of the semiconductor chip; and a seal member disposed on the coating layers of the pair of semiconductor chips so as to seal the opening of the common channel.

4. A process for producing a liquid discharge head, comprising:

forming a plurality of heating elements on a semiconductor substrate, the heating elements being arranged in a direction;

forming a sacrificial layer on a region including the heating elements, the sacrificial layer being soluble in a dissolving liquid;

forming a coating layer on the sacrificial layer;

forming nozzles in regions of the coating layer after, each of the regions being located above the corresponding heating element, and each of the nozzles passing through the coating layer;

cutting the semiconductor substrate along the stacking direction of the sacrificial layer and the coating layer to form semiconductor chips each exposing the sacrificial layer at the corresponding cut end; and immersing the semiconductor chips formed in the fifth step in the dissolving liquid to dissolve the sacrificial layer, bonding each semiconductor chip a liquid feed member including a common channel passing through a base in such a manner that each cut end of the corresponding semiconductor chip faces the common channel; and sealing an opening of the common channel with a seal member in such a manner that the seal member is disposed on the liquid feed member and the coating layer of each semiconductor chip bonded in the bonding step; and further wherein ink flow paths at surfaces of the semiconductor chip have not been formed by etching the semiconductor chip.

5. The process for producing a liquid discharge head according to claim 4, wherein the bonding step is performed for each semiconductor chip.

6. A process for producing a liquid discharge head, comprising:

forming a plurality of heating elements on a semiconductor substrate, the heating elements being arranged in a direction;

forming a sacrificial layer on a region including areas on the heating elements, the sacrificial layer being soluble in a dissolving liquid;

forming a coating layer on the sacrificial layer;

forming nozzles in regions of the coating layer, each of the regions being located above a corresponding one of the heating elements, and each of the nozzles passing through the coating layer;

cutting the semiconductor substrate along the stacking direction of the sacrificial layer and the coating layer to form semiconductor chips each exposing the sacrificial layer at the corresponding cut end; and immersing the semiconductor chips formed in the fifth step in the dissolving liquid to dissolve the sacrificial layer, bonding a pair of the semiconductor chips to a liquid feed member including a common channel passing through a base in such a manner that the cut ends of the semiconductor chips are disposed across the common channel from each other so as to face each other; and sealing an opening of the common channel with a seal member in such a manner that the seal member is disposed on the coating layers of the semiconductor chips; and further wherein ink flow paths at surfaces of the semiconductor chip have not been formed by etching the semiconductor chip.

7. The process for producing a liquid discharge head according to claim 6, wherein the bonding step is performed for each of the semiconductor chips.

* * * * *